US011498646B1

(12) United States Patent
Hager

(10) Patent No.: US 11,498,646 B1
(45) Date of Patent: Nov. 15, 2022

(54) BOAT CANOPY WITH WORM GEAR DRIVE UNIT

(71) Applicant: Gary Hager, Edina, MN (US)

(72) Inventor: Gary Hager, Edina, MN (US)

( * ) Notice: Subject to any disclaimer, the term of this patent is extended or adjusted under 35 U.S.C. 154(b) by 0 days.

(21) Appl. No.: 17/702,773

(22) Filed: Mar. 23, 2022

(51) Int. Cl.
*B63B 17/02* (2006.01)

(52) U.S. Cl.
CPC ..... *B63B 17/02* (2013.01)

(58) Field of Classification Search
CPC ..... B63B 17/02
See application file for complete search history.

(56) References Cited

U.S. PATENT DOCUMENTS

| | | | | |
|---|---|---|---|---|
| 1,030,775 | A | 6/1912 | Goddu | |
| 1,055,476 | A | 3/1913 | Krayer | |
| 1,640,492 | A | 8/1927 | Harry | |
| 5,092,262 | A | 3/1992 | Lacy | |
| 6,209,477 | B1 * | 4/2001 | Biedenweg | B60J 7/1282 114/361 |
| 7,246,835 | B1 | 7/2007 | Colburn et al. | |
| 7,389,737 | B1 * | 6/2008 | Schwindaman | B63B 17/02 114/361 |
| 7,438,015 | B1 * | 10/2008 | Schwindaman | B63B 17/02 114/361 |
| 7,895,964 | B2 * | 3/2011 | Russikoff | B63B 17/02 114/361 |
| 8,205,571 | B1 | 6/2012 | Rondeau et al. | |
| 8,302,552 | B2 | 11/2012 | Dover | |
| 8,752,498 | B1 * | 6/2014 | Schwindaman | B63B 17/02 114/361 |
| 9,038,875 | B2 | 5/2015 | Jesewitz | |
| 9,862,461 | B2 * | 1/2018 | Cao | B63B 17/02 |
| 10,260,566 | B2 | 4/2019 | Salerno | |
| 11,046,394 | B1 * | 6/2021 | Ritchel | B63B 17/02 |
| 11,338,889 | B2 * | 5/2022 | Shearer | B63B 17/02 |
| 2021/0047003 | A1 * | 2/2021 | Shearer | B63B 17/02 |

FOREIGN PATENT DOCUMENTS

| | | |
|---|---|---|
| JP | 2009543723 A | 12/2009 |

* cited by examiner

*Primary Examiner* — Anthony D Wiest
(74) *Attorney, Agent, or Firm* — Juneau & Mitchell; Todd L. Juneau

(57) ABSTRACT

The invention relates to a bimini-style boat cover frame having electronically actuated worm gear drive units, the worm gear drive unit mounted on a boat and connected to a front frame assembly and a back frame assembly that supports a canopy covering.

18 Claims, 13 Drawing Sheets

FIGURE 2 - alternate embodiment

FIGURE 18

Processing Steps
for
using a bimini-style boat cover
with a wireless electronic device STEP 1: sending a command from the wireless electronic device
using infrared signals or ultra-high frequency (UHF) (Bluetooth) signals
to a bimini-style boat cover that is connected to power, wherein the command is selected from
a menu of commands comprising
raise the bimini,
lower the bimini,
control voltage to the motor,
control current to the motor,
control battery voltage,
collect motor feedback,
register new Bluetooth user,
assign Bluetooth user password,
display usage history, and
display system faults;

STEP 2: receiving the command
at the electronic controller
of the bimini-style boat cover and
executing the command on the processor
using programming code saved to memory, wherein a command to
raise the bimini and lower the bimini
actuates the DC motor to drive the worm gear
connected to frame assembly, wherein a command to control voltage to the DC motor
modifies the speed of the DC motor and
control current to the DC motor
modifies the torque of the DC motor, wherein a command to control battery voltage
modifies the voltage incoming from a battery power supply, and wherein a command to collect DC motor feedback,
register new Bluetooth user, assign Bluetooth user password,
display usage history, and display system faults
operates to process data received from the electronic controller and
generate a graphic on a display screen
on the wireless electronic device.

BOAT CANOPY WITH WORM GEAR DRIVE UNIT

BACKGROUND OF THE INVENTION

Field of the Invention

The invention relates to a boat cover, and specifically a motorized boat cover known as a bimini that uses a specialized actuator having synchronized worm-gears.

DESCRIPTION OF THE RELATED ART

A bimini top is a rain or sun cover on a boat or aquatic vehicle for providing protection from the elements to the boat occupants while the boat is in use. Some bimini designs extend or retract the canvas or cover manually. Some bimini designs use hydraulic cylinders from a metal supporting frame. Manual biminis can be laborious for the user when out on the water, and hydraulic cylinders on other biminis are expensive, difficult to maintain in marine environments, and take up usable space on the boat. Other previous bimini designs use drive screws or rack and pinion systems, which may require a lot of power to drive the system to full extension and may be prone to mechanical issues in a marine environment. Accordingly, there is a need for improved bimini mechanisms that can provide electronic synchronization for bimini actuators with a controller, has a more effective gearing location and operation, is enclosed/weather proof, has gears that does not strip under large forces, does not have gears that lock up, and wears out less often.

U.S. Pat. No. 6,209,477 discloses a retractable top for a boat having at least one strut having a first end attached to the top, and motor driven retraction device attached to the boat. The electrically driven device is attached to the boat and operatively coupled to the strut by means of a rack and pinion arrangement. The strut is moved between its first and second positions by the electrically driven device, whereby the top is electrically raised and lowered.

U.S. Pat. No. 7,895,964 discloses a retractable boat top device having an arched canopy assembly operatively deployed in mounted attachment upon a conventional radar arch or like elevated structure on the deck of a boat. The arched canopy assembly includes a stationery roof section formed having a curved planar surface transversely mounted within the radar arch, a pair of telescoping extension arms mounted on opposite sides of the roof section, and an arched roller assembled to hold a flexible canopy material thereon and operatively connected between the outer ends of the extension arms so that the flexible canopy material may be extended and retracted relative to the stationery roof section in an arched configuration substantially in the same plane as the roof section. The arched roller includes a curved roller bar supported coaxially Within the bore of a flexible hose member that supports the canopy material in a rolled-up state and further includes torsion spring members mounted along opposite sides of the roller bar to maintain tension upon the canopy material during roll-out and retraction.

U.S. Pat. No. 9,862,461 discloses an awning for a boat is operable between retracted and extended positions and includes a frame structure having left and right telescopically extendable and retractable tube assemblies each having a fixed tube, a telescopic mid tube and a telescopic end tube. Cross tubes extend transversely between each of the mid tubes and the end tubes. A canvas roller is mounted transversely between the fixed tubes. A sheet of marine canvas is secured to the roller and the end cross tube and is rolled onto the roller when the awning is retracted. A gear box disengages the canvas roller to allow the telescoping tube assemblies and canvas to be manually extended. To retract the awning, the gear box is engaged with the canvas roller and a removable crank handle is operated to rotate the roller and roll up the canvas as the frame structure is telescopically retracted.

U.S. Pat. No. 11,046,394 discloses an articulating top having a frame, a cover attached to the frame and a mounting bracket to attach the frame to a vehicle can be moved between a deployed position to provide shelter to an area below the top and a stowed position. The frame having main and secondary frame members in addition to one or more struts between a frame member and the vehicle to provide additional support to the frame such that the top can be used while the vehicle is in motion or in windy conditions. The top may also use one or more braces.

U.S. patent publication 2021-0047003 discloses a drive mechanism for a bimini top with a pair of bimini arms supporting the bimini top includes a motor, a worm screw coupled with the motor for rotation by the motor, and a driven gear coupled with the worm screw. One of the pair of bimini arms is connected to the driven gear, and the driven gear is configured for displacement between a stowed position and an extended position by operation of the motor. A pivot hub engages the driven gear via an intermediate hub, and the other of the pair of bimini arms is connected to the pivot hub. The pivot hub and intermediate hub are configured for displacement between a down position and an up position by operation of the motor through the driven gear and the intermediate hub. A first arc spanned by the driven gear between the stowed position and the extended position is greater than a second arc spanned by the pivot hub between the down position and the up position.

SUMMARY OF THE INVENTION

The invention is directed to a bimini-style boat cover frame, comprising two synchronized electronically actuated worm gear drive units, each drive unit mounted on either side of (port and starboard) a boat and connected to a front frame assembly and a back frame assembly that supports a canopy covering.

In one preferred embodiment of the invention, there is provided a bimini-style boat cover frame, comprising two synchronized electronically actuated worm gear drive units, each drive unit mounted on either side of (port and starboard) a boat and connected to a front frame assembly and a back frame assembly that supports a canopy covering, wherein the front frame assembly is configured as an inverted u-shaped arch comprising a port-side front strut connected to a starboard-side front strut using a curved front center arch, the front frame assembly also having a short interior arch comprising a port-side short front strut connected to a starboard-side short front strut using a curved front interior center arch, the port-side short front strut connected to a mid-section portion of the port-side front strut and the starboard-side short front strut connected to a mid-section portion of the starboard-side front strut, and wherein the back frame assembly is configured as an inverted u-shaped arch comprising a port-side back strut connected to a starboard-side back strut using a curved back center arch, the back frame assembly also having a short interior arch comprising a port-side short back strut connected to a starboard-side short back strut using a curved back interior center arch, the port-side short back strut connected to a mid-section portion of the port-side back strut and the starboard-side short back strut connected to a mid-section portion of the starboard-side back strut, and wherein the front frame and the back frame are attached to a canopy wherein the canopy covers the curved front center arch, the curved front interior center arch, covers the curved back center arch, and covers the curved back interior center arch, and wherein the canopy covers a top curved portion of the port-side front strut, a top curved portion of the starboard-side front strut, a top curved portion of the port-side short front strut, and a top curved portion of the starboard-side short front strut, and wherein the canopy covers a top curved portion of the port-side back strut, a top curved portion of the starboard-side back strut, a top curved portion of the port-side short back strut, and a top curved portion of the starboard-side short back strut, and wherein a port-side worm gear drive unit is connected to and synchronously drives the port-side front strut, and a starboard-side worm gear drive unit is connected to and synchronously drives the starboard-side front strut.

In an additional preferred embodiment, the port-side rear strut mount is slidably adjustable to travel closer and further to the port-side worm gear drive unit, and the starboard-side rear strut mount is slidably adjustable to travel closer and further to the starboard-side worm gear drive unit.

In another preferred embodiment, the port-side and starboard-side worm gear drive units include a planetary reducer, and a specific worm gear ratio to eliminate back-drive, preventing slippage.

In another preferred embodiment, the port-side and starboard-side worm gear drive units have a variable speed motor, configured for automatic pre-programmed stops, and configured for slowing speed to provide soft-stops.

In another preferred embodiment, the port-side worm gear is connected to and synchronously drives both the port-side front strut and the port-side back strut, and a starboard-side worm gear is connected to and synchronously drives both the starboard-side front strut and the starboard-side back strut.

In another preferred embodiment, the drive unit is wired or wireless.

In another preferred embodiment, the port-side worm gear and the starboard-side worm gear are mounted on the boat at a position that directly below an outer edge of the canopy space between the curved front interior center arch and the curved back interior center arch to balance strut forces from wind or rain that translate from the canopy movement to gear pressure through the struts.

In another preferred embodiment, the worm gear housing is enclosed and weather proof.

In another preferred embodiment, the worm gear is enclosed and a submersion test allows in less than 20 ml of water compared to other gearing, wherein the worm gear has resistance to stripping force having a range to resist stripping force from 400 ft lbs to 1100 ft lbs., wherein the worm gear maintains function under force, where tooth and pawl locks above 300 ft lbs of force, the inventive worm gear does not lockup at 300 ft lbs of force, and wherein the worm gear ranges from 5000 to 100,000 travels between replacements.

BRIEF DESCRIPTION OF THE FIGURES

FIG. 18 is an electronic flowchart illustrating the processing Steps for using a bimini-style boat cover with a wireless electronic device.

DETAILED DESCRIPTION

Figure 1:
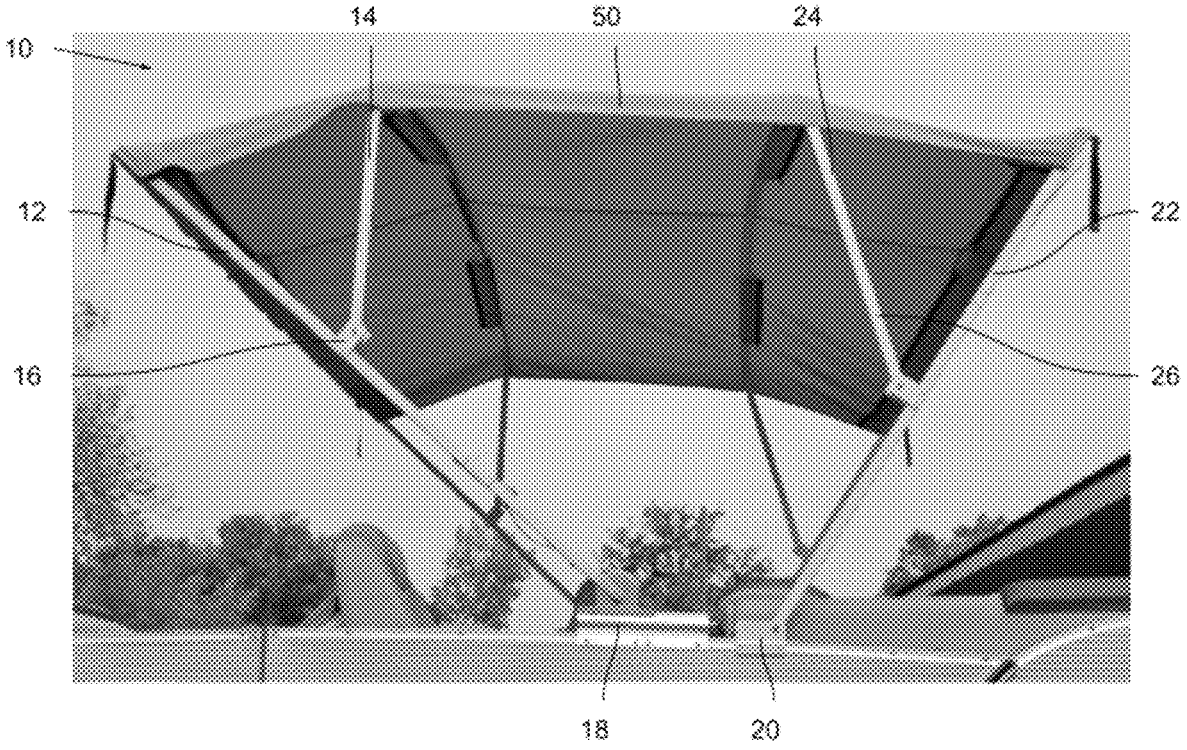
FIG. 1 is a side-perspective, photographic view of one embodiment of the boat canopy with synchronized dual worm gears.

Disclosed herein are embodiments for a bimini-style boat cover, comprising a front frame assembly and a back frame assembly that support a canopy covering, the front frame assembly operatively connected to a first electronically actuated worm gear drive unit, the worm gear drive unit mounted on a boat, the worm gear drive unit having a housing containing a worm gear motor assembly comprising a controller connected to a DC motor that engages directly with a planetary gear reducer before engaging a worm screw, said worm screw having thrust bearings at each end, and said worm screw engaging teeth of a worm gear, said worm gear connected to the front frame assembly, the worm gear drive unit configured to raise the front frame assembly from a stowed first position to a raised second position, the back frame assembly pivotally mounted on the boat and configured to rotate in response to the canopy covering attached to the front frame assembly when the front frame assembly moves from the stowed first position to the raised second position, said controller comprising a processor, non-volatile memory, a control sensor attached to the DC motor, and programming code executable on the processor configured to control motor voltage and control motor current.

In another embodiment, the bimini-style boat cover comprises a front frame assembly and a back frame assembly that supports a canopy covering, the front frame assembly operatively connected to an electronically actuated port-side worm gear drive unit and an electronically actuated starboard-side worm gear drive unit, the port-side worm gear drive unit is synchronized with the starboard-side worm gear drive unit to raise and lower the front frame assembly, the port-side worm gear drive unit mounted on a port side of a boat and the starboard-side worm gear drive unit mounted on a starboard side of the boat.

Any of the embodiments herein may include programming code executable on a processor that is configured to control battery voltage, control an autostop function, and collect and save motor feedback.

Any of the embodiments herein may include wherein the electronic controller includes a Bluetooth module having a Bluetooth antenna and programming code executable on the processor configured to connect by Bluetooth to a smartphone, receive commands from the smartphone to the controller, and send motor feedback to the smartphone.

Any of the embodiments herein may include a second electronically actuated worm gear drive unit, the front frame assembly having a port side strut and a starboard side strut connected by a center arch member, the first electronically actuated worm gear drive unit operatively connected to the port side strut, and the second electronically actuated worm gear drive unit operatively connected to the starboard side strut, the first electronically actuated worm gear drive unit and the second electronically actuated worm gear drive unit in electronic communication to effect synchronized movement to the port side strut and the starboard side strut when the front frame assembly moves between the stowed first position and the raised second position.

Any of the embodiments herein may include a second electronically actuated worm gear drive unit operatively connected to the back frame assembly, the first electronically actuated worm gear drive unit and the second electronically actuated worm gear drive unit in electronic communication to effect synchronized movement to the front frame assembly and the back frame assembly when the front frame assembly moves between the stowed first position and the raised second position.

Any of the embodiments herein may include wherein the planetary gear reducer provides an 84:1 ratio from the DC motor into the worm screw.

Any of the embodiments herein may include wherein the worm screw and worm gear have a ratio of 50:1.

Any of the embodiments herein may include wherein the front frame assembly is configured as an inverted u-shaped arch comprising a port-side front strut connected to a starboard-side front strut using a curved front center arch, the front frame assembly also having a short interior arch comprising a port-side short front strut connected to a starboard-side short front strut using a curved front interior center arch, the port-side short front strut connected to a mid-section portion of the port-side front strut and the starboard-side short front strut connected to a mid-section portion of the starboard-side front strut, and wherein the back frame assembly is configured as an inverted u-shaped arch comprising a port-side back strut connected to a starboard-side back strut using a curved back center arch, the back frame assembly also having a short interior arch comprising a port-side short back strut connected to a starboard-side short back strut using a curved back interior center arch, the port-side short back strut connected to a mid-section portion of the port-side back strut and the starboard-side short back strut connected to a mid-section portion of the starboard-side back strut, and wherein the front frame and the back frame are attached to a canopy wherein the canopy covers the curved front center arch, the curved front interior center arch, covers the curved back center arch, and covers the curved back interior center arch, and wherein the canopy covers a top curved portion of the port-side front strut, a top curved portion of the starboard-side front strut, a top curved portion of the port-side short front strut, and a top curved portion of the starboard-side short front strut, and wherein the canopy covers a top curved portion of the port-side back strut, a top curved portion of the starboard-side back strut, a top curved portion of the port-side short back strut, and a top curved portion of the starboard-side short back strut.

Any of the embodiments herein may include wherein the port-side rear strut mount is slidably adjustable to travel closer and further to the port-side worm gear drive unit, and the starboard-side rear strut mount is slidably adjustable to travel closer and further to the starboard-side worm gear drive unit.

Any of the embodiments herein may include wherein the port-side and starboard-side worm gear drive units include a planetary reducer, and a specific worm gear ratio to eliminate backdrive, preventing slippage.

Any of the embodiments herein may include wherein the DC motor is a variable speed motor, and wherein the controller is configured for automatic pre-programmed stops, and configured for slowing speed to provide soft-stops.

Any of the embodiments herein may include wherein the port-side worm gear is connected to and synchronously drives both the port-side front strut and the port-side back strut, and a starboard-side worm gear is connected to and synchronously drives both the starboard-side front strut and the starboard-side back strut.

Any of the embodiments herein may include wherein the port-side and the starboard-side worm gear drive units are configured for electronically synchronized independent drives, wherein the port-side worm gear is connected to and synchronously drives both the port-side front strut and the port-side back strut, and the starboard-side worm gear is connected to and synchronously drives both the starboard-side front strut and the starboard-side back strut.

Any of the embodiments herein may include wherein the worm gear drive unit controller is wired or wireless.

Any of the embodiments herein may include wherein the port-side worm gear and the starboard-side worm gear are mounted on the boat at a position that directly below an outer edge of a canopy space between a curved front interior center arch and a curved back interior center arch to balance strut forces from wind or rain that translate from canopy movement to gear pressure through the front frame assembly and the back frame assembly.

Any of the embodiments herein may include wherein the worm gear housing is enclosed and weather proof.

Any of the embodiments herein may include wherein the worm gear is enclosed and a submersion test allows in less than 20 ml of water into the housing, wherein the worm gear has resistance to stripping force having a range to resist stripping force from 400 ft lbs to 1100 ft lbs., wherein the worm gear maintains function under force and does not lock up at 400 ft lbs to 1100 ft lbs of force, and wherein the worm gear ranges from 5000 to 100,000 travels between replacements.

Any of the embodiments herein may include where a sensor is used for the motor revolutions by having the digital sensor device on the back of the DC motor to count pulses for speed and position control. In a preferred embodiment, both actuators (motors) have independent digital control and feedback.

Any of the embodiments herein may include where the controller detects its output voltage and current to the motor and will vary the voltage (speed) and current (torque) based on the feedback from the motor.

Any of the embodiments herein may include where the strut angles are determined by knowing the gear ratios and having the controller count the feedback to know the position. There are multiple pulses per motor revolution on each motor to provide enough feedback to know position.

Any of the embodiments herein may include where the control unit has memory. Preferably the control unit has non-volatile memory and the positions of the frame assemblies are saved even if power is lost.

Any of the embodiments herein may include where the controller can log hours used, or times used, or revolutions, etc. Additionally, any of the embodiments herein may include where the controller is operated from a Bluetooth Mobile Phone APP (iOS and Android) that will log the number of times UP/DOWN along with displays for motor voltage, motor current, battery voltage, feedback for both motors, whether the auto stop positions are programmed and fault display and fault history. Any of the embodiments herein may include where a user can also operate the Bimini from smartphone via Bluetooth.

Any of the embodiments herein may include where the bimini does not require all of the smartphone enabled functions, and does not have feedback on motors, does not have an advanced controller and operates only with an UP/DOWN switch mounted in the helm (less expensive and simple).

Any of the embodiments herein may include wherein the worm gear doesn't strip under pressure that would strip a rack-and-pinion gear, maintains function under large forces and doesn't lockup under forces where a rack-and-pinion gear locks up, and wears out less often rack-and-pinion gears.

Any of the embodiments herein may include wherein the worm gear is enclosed and a submersion test allows in less than 20 ml of water compared to other gearing.

Any of the embodiments herein may include wherein the worm gear has resistance to stripping force, wherein tooth and pawl fails at 400 ft lbs, whereas the inventive worm gear goes to 1100 ft lbs, and has a range to resist stripping force from 400 ft lbs to 1100 ft lbs.

Any of the embodiments herein may include wherein the worm gear functions under force from 400 ft lbs to 1100 ft lbs, where tooth and pawl locks above 300 ft lbs of force, the inventive worm gear does not lockup.

Any of the embodiments herein may include wherein the worm gear has increased wear resistance, where a tooth and pawl need replacing every 5000 travels, the inventive worm gear goes to 100,000 travels, and ranges from 5000 to 100,000 travels between replacements.

TERMINOLOGY

The terminology used herein is for the purpose of describing particular embodiments only and is not intended to limit the full scope of the claims. Unless defined otherwise, all technical and scientific terms used herein have the same meanings as commonly understood by one of ordinary skill in the art. Nothing in this disclosure is to be construed as an admission that the embodiments described in this disclosure are not entitled to antedate such disclosure by virtue of prior invention.

As used herein, the singular forms "a", "an" and "the" are intended to include the plural forms as well, unless the context clearly indicates otherwise. With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

In general, terms used herein, and especially in the appended claims (e.g., bodies of the appended claims) are generally intended as "open" terms (e.g., the term "including" should be interpreted as "including but not limited to," the term "having" should be interpreted as "having at least," etc.). Similarly, the terms "comprises" and/or "comprising," when used in this specification, specify the presence of stated features, integers (or fractions thereof), steps, operations, elements, and/or components, but do not preclude the presence or addition of one or more other features, integers (or fractions thereof), steps, operations, elements, components, and/or groups thereof. As used in this document, the term "comprising" means "including, but not limited to."

As used herein the term "and/or" includes any and all combinations of one or more of the associated listed items. It should be understood that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

All ranges disclosed herein also encompass any and all possible subranges and combinations of subranges thereof unless expressly stated otherwise. Any listed range should be recognized as sufficiently describing and enabling the same range being broken down into at least equal subparts unless expressly stated otherwise. As will be understood by one skilled in the art, a range includes each individual member.

The embodiments herein, and/or the various features or advantageous details thereof, are explained more fully with reference to the non-limiting embodiments that are illustrated in the accompanying drawings and detailed in the following description. Descriptions of well-known components and processing techniques are omitted so as to not unnecessarily obscure the embodiments herein. Like numbers refer to like elements throughout.

The examples and/or embodiments described herein are intended merely to facilitate an understanding of structures, functions, and/or aspects of the embodiments, ways in which the embodiments may be practiced, and/or to further enable those skilled in the art to practice the embodiments herein.

Similarly, methods and/or ways of using the embodiments described herein are provided by way of example only and not limitation. Specific uses described herein are not provided to the exclusion of other uses unless the context expressly states otherwise.

MATERIALS & METHODS

The struts, connectors, pins, screws, rivets, and housing that comprise the front and back frame and the drive unit housing are preferably made from aluminum, but may also be made from anodized metal, steel, other suitable metal alloys, polymers/plastics, carbon fiber, resins, fiber reinforced composite materials, and/or combinations thereof.

The canopy may be made of standard canopy materials such as polyester, but may also be made from polyester/vinyl composites, acrylic fabrics, and composites. The canopy is preferably waterproof or water-repellant, able to fold during retraction and expand during extension, and is preferably fade resistant, weather resistant, mold resistant, and UV resistant.

The term "bimini" refers to a frame-supported covering on a boat to reduce sun, rain, and wind exposure.

The term "frame assembly" refers to a collection of stiff, often metallic, tubes or spanning members used to support a flexible canvas or Dacron (polyester) covering.

The term "canopy covering" refers to a canvas, polyester, or other cloth-like flexible material attached to a frame for use as sun, rain, or wind protection, especially on a boat.

The term "electronically actuated" means controlled by means of voltage changes (speed) or current (torque), as it relates to motors.

The term "worm gear drive unit" refers to the components within the housing, namely a controller unit, a DC motor, a planetary gear reducer, a worm screw, thrust bearings, a worm gear, and a forked strut or other similar connector to the frame assembly.

The term "stowed first position" refers to the bimini cover in a flattened, lowered configuration.

The term "raised second position" refers to the bimini cover in a opened, spread out configuration.

The term "pivotally mounted on the boat" refers to the frame assembly being able to rotate between raised and stowed positions, either passively or under control of the worm gear drive unit.

The term "controller" or "electronic controller" refers to a solid-state (electronic) device usually consisting of a power supply, an input component, a sensor amplification circuit, a process/comparing circuit, an output driver section, and various components that sense changes in the controlled variable and derive a control output which provides a specific control function. More specifically, the controller in connected to and controls the DC motor in response to commands received from wired local switches or wireless controls (handheld or smartphone). The controller also receives sensor information about the DC motor and transmits data according to programming. The controller may also include memory, such a non-volatile memory, a processor, other system circuitry, saved programming code, sensor controls, motor controls for voltage and current, battery controls, autostop control, softstop control, motor feedback controls, and components for connecting via Bluetooth to a smartphone application.

The term "DC motor" refers to marine motors having 12 volts, but may also have 6 or 24 volts, and specifically to motors having a controller providing variable output configured for actuating a bimini cover from a stowed position to an open or raised position, and return.

FIGURES

Referring now to FIG. 1, FIG. 1 is a side-perspective, photographic view of one embodiment of the invention. FIG. 1 shows the bimini boat cover with worm gear 10 having front strut 12 attached to front interior strut 14 using pivoting connector 16. Back strut 22 and back interior strut 24 are shown with pivoting connector 26. The front strut 12 of the front frame and the back strut 22 of the back frame are shown leading to worm gear assembly 18, 20. Worm gear enclosed motor assembly 18 comprises a drive mechanism contained in a housing, with one housing mounted to each side of the boat structure. The housing is generally made of aluminum but could also be made of any other suitable metal or composite material for withstanding outside elements. The housing could be mounted to the boat structure by any known method of securement, including but not limited to bolting, welding, or the use of adhesives. The housing is preferably enclosed and waterproof or weatherproof.

The housing contains the components of the drive mechanism. As shown, the drive mechanism may include a 12V DC motor, a planetary gear reducer, a worm screw, a worm gear, and thrust bearings on both sides of the worm gear to handle loads including winds. The components can be collectively referred to as the actuation mechanism and the gear train, both of which will be described in more detail below.

The actuation mechanism includes the motor, a planetary gear reducer, worm screw, and worm gear. The planetary gear reducer provides efficiency and ratio. The worm screw and worm gear could generally be referenced together as a worm drive. The worm drive provides strength, ratio, and prevents backdrive so that it can hold the load required when the canopy is impacted by wind and other forces. In the embodiment shown, the motor is secured within the housing, but may be excluded from the housing or may otherwise be covered in other embodiments. The motor may directly engage the planetary gear reducer, which then engages the worm screw, or a worm shaft (not shown) may be used to communicate power from the motor to the frame strut. The worm screw may also be secured and positioned in the housing by a bracket that is bolted into opposite sides of the housing. The worm screw is generally positioned below the gear train for communicating power through the worm drive and driving the gear train.

The gear train includes thrust bearings on both sides of the worm gear to handle loads including winds. As shown, each bearing is rotatable about a bolt or axle secured through opposite sides of the housing. The thrust bearings are operably connected with the worm gear driven by the worm screw and have gear teeth in meshing engagement with gear teeth of the worm screw. The worm gear is rotatably mounted to an arm connector for mating connection with a frame strut. The worm gear is circular with the gear teeth on its circumference. The ratio of gear teeth to worm screw is preferably about 50:1, but can also range from 20:1 to 100:1, including any intermediate ranges therein. The planetary gear reducer has a gear ratio of preferably 84:1, but can also range in alternative embodiments from 40:1 to 150:1.

The arm connector and associated bimini frame strut are pivoted between a retracted or down position, and an extended or up position.

The controller will vary the voltage (speed) and current (torque) to the motor. Thus, the controller has variable speeds. It will automatically slow down and the end stops—UP and DOWN stops—called herein as a "soft stop". It will automatically stop at the "programmable" end stops. As used herein, this is called an "auto stop"—wherein a user simply holds the UP or DOWN button until the system automatically stops.

For synchronizing the left side with the right side, both actuators provide feedback to the controller. The controller synchronizes the actuators based on the feedback to control speed and position.

For controlling motor (actuator) revolutions, there is a digital sensor device on the back of each motor to count pulses for speed and position control. In a preferred embodiment, both actuators (motors) have independent digital feedback. Since the controller detects its output voltage and current to the motor, this will vary the voltage (speed) and current (torque) based on the feedback from the motor.

For sensing the strut angles, the controller is configured to know the gear ratios and the count to provide the feedback required to know the position and strut angles. In a preferred embodiment, there are multiple pulses per motor revolution on each motor to provide enough feedback to know position.

For the control of the output shaft movement, the motor will spin many revolutions with respect to output shaft movement, and combined with the sensor on the back of each motor, provides feedback for good control.

In a preferred embodiment, the control unit has non-volatile memory and will remember the shaft and gear positions even if power is lost. Non-limiting examples include read-only (ROM), erasable programmable ROM, electronically erasable programmable ROM, Ferroelectric RAM, Flash memory, NAND memory, NAND Flash memory, 3-D NAND (NVM), Solid State drives (SSD), conductive-bridging RAM, domain-wall, millipede NVM, Nano RAM, phase change PCM/P-RAM, and resistive random access memory (RRAM).

In a preferred embodiment, the control unit can, by itself or in combination with a paired Bluetooth App on a smartphone, log the number of hours used, or the number of times used, or revolutions, etc. The control unit and/or Bluetooth App (iOS and Android) is able to log the number of times UP/DOWN along with displays (local or on smartphone) for motor voltage, motor current, battery voltage, feedback for both motors, whether the auto stop positions are programmed and fault display and fault history. In a preferred embodiment, the Bimini can be operated from a user's smartphone via Bluetooth.

In another preferred embodiment, a simpler version is also contemplated that simply provides a synchronously controlled worm gear driven auto-Bimini, without the smart functions or feedback on motors, and operates only with an UP/DOWN switch mounted in the helm.

In a preferred embodiment, the drive unit is only driving the front strut. In this embodiment, the worm screw/shaft 60 (not visible)(see FIGS. 14 and 15 element 1235) drives the front arch, and the other arches follow along since they are mechanically connected with aluminum arches attached with canvas top 50 that ties them together. In another alternate embodiment, the length of the screw/shaft extends over to a second worm gear attached to the rear strut, so both the front strut and the rear strut are independently driven from different parts of the same extended shaft (see FIG. 2 element 60).

In a preferred embodiment, the back arch has an angled "foot". The angled "foot" will make contact with the rear arch bracket to make the Bimini top tight. The invention may also include wherein the rear angled "foot" includes a "spring" so the angled foot can extend beyond a hard stop but still have the canvas top 50 tight.

Any of the preferred embodiments herein may include wherein the drive unit is within a weatherproof housing. Any of the the preferred embodiments herein may include wherein the mount for the front strut and the mount for the back strut are enclosed in the same weatherproof housing.

In another preferred embodiment, the front mount and the back mount are separate "bases" to spread out the load—better performance. In another embodiment, the mounts or bases, and preferably the rear mounts, are slidably adjustable to be closer together or further apart. Being adjustable, the closer the rear arch bracket is mounted to the actuator, the farther "down" the front arch of the Bimini can travel. This can be preferable when users want to pick the front arch travel point for shade, especially important since boats and pontoon boats, do not travel "flat"; rather they travel at an angle depending on speed. Conversely, the farther apart the rear arch bracket from the actuator, the farther "UP" the front arch Bimini travel.

Figure 2:
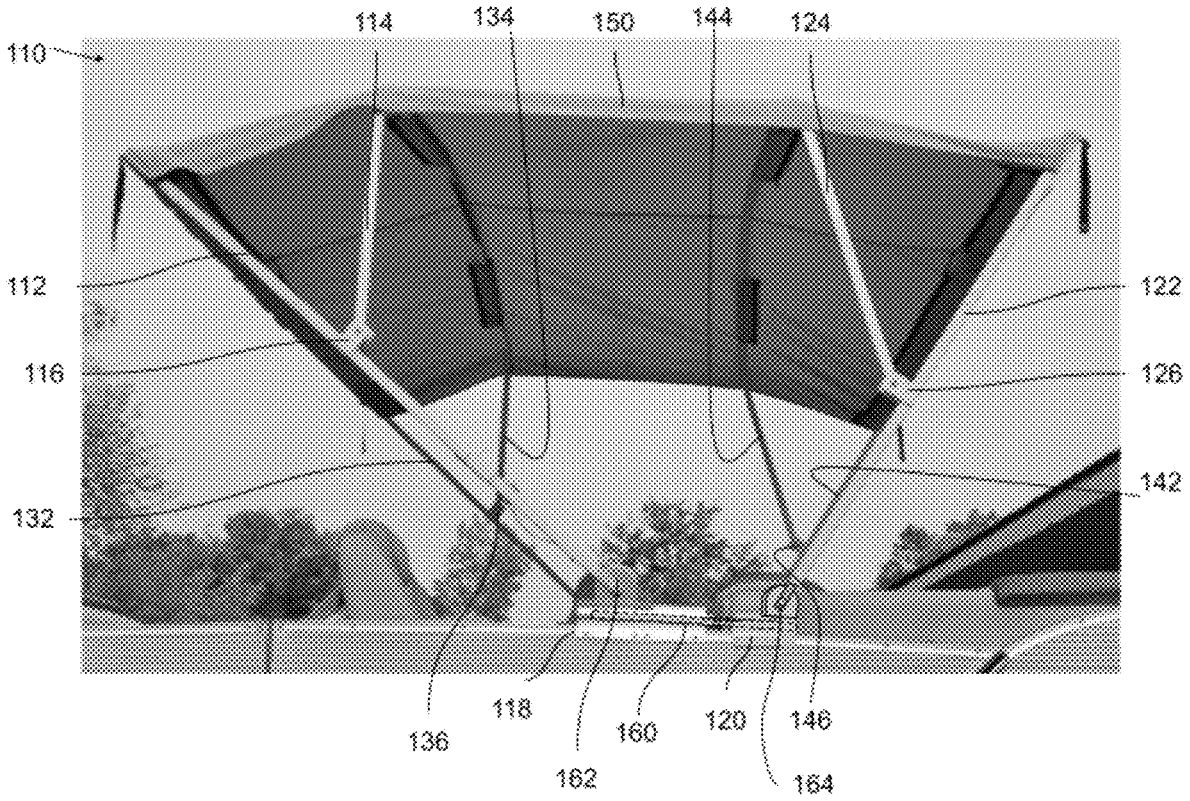
FIG. 2 is a side-perspective, photographic view of another embodiment of the boat canopy with synchronized dual worm gears.

FIG. 2 is a side-perspective, photographic view of another embodiment of the invention. FIG. 2 shows an embodiment where the length of the screw/shaft extends over to a second worm gear attached to the rear strut, so both the front strut and the rear strut are independently driven from different parts of the same extended shaft 160. FIG. 2 shows the bimini boat cover 110 with worm gear drive units 162 and 164 having port-side front strut 112 attached to port-side front interior strut 114 using port-side front pivoting connector 116. Port-side back strut 122 and port-side back interior strut 124 are shown with port-side back pivoting connector 126. The port-side front strut 112 of the front frame are shown leading to port-side front worm gear assembly 162 with mount 118 and the port-side back strut 122 of the back frame is shown leading to second worm gear assembly 164 with second mount 120. Starboard-side front pivoting connector 136 and starboard-side back pivoting connector 146 are shown mirroring the port-side pivoting connectors 116, 126. Worm gear enclosed motor assembly 162 and 164 comprise a drive mechanism contained in a housing. A symmetrical system of drive units and struts are mounted on the starboard-side of the boat, with each housing mounted to each side of the boat structure.

FIG. 2 also shows canopy cover 150 supported on the starboard-side with starboard-side front frame strut 132 and starboard-side front interior strut 134. Starboard-side back frame strut 142 is shown connecting to starboard-side back interior strut 144.

Figure 3:
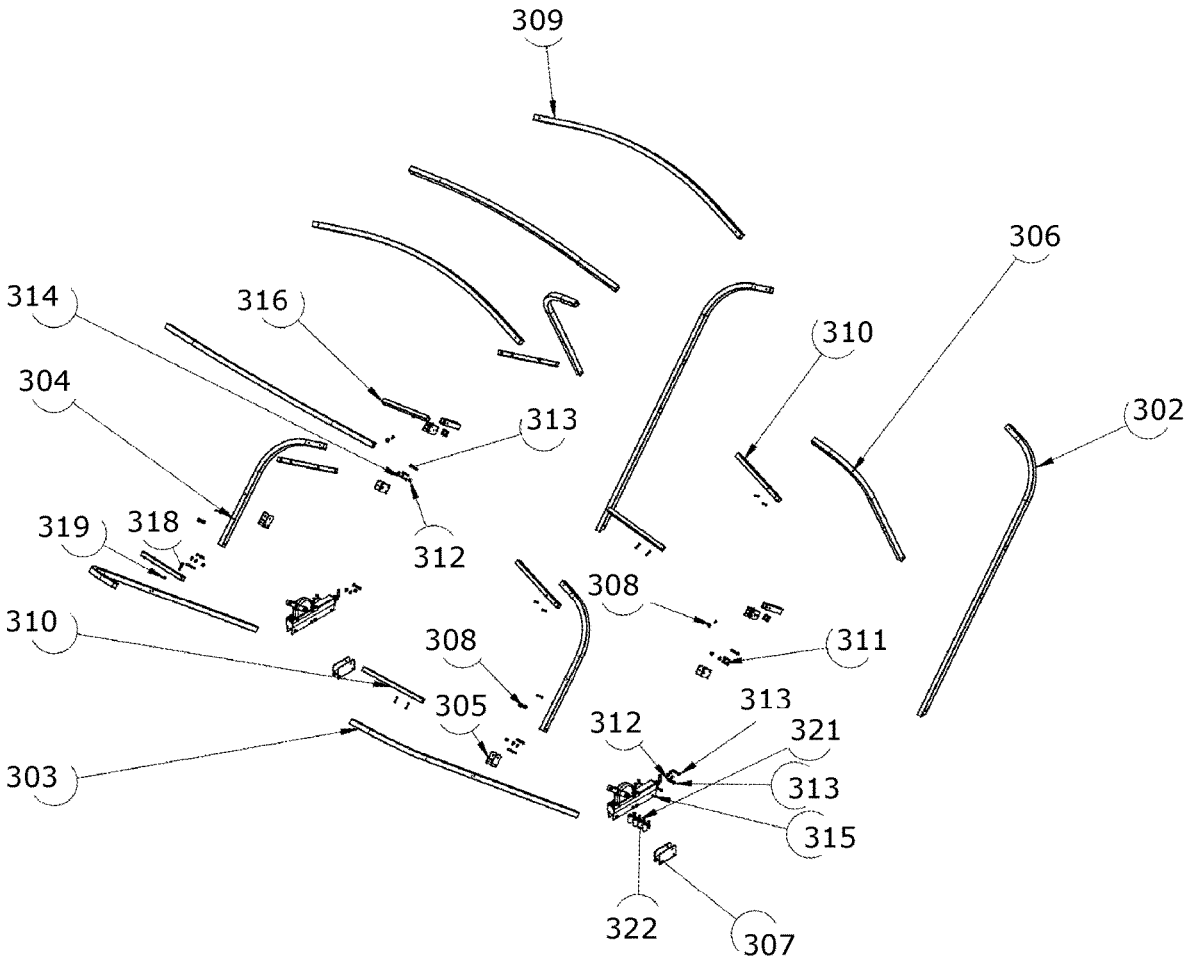
FIG. 3 is an exploded view of an embodiment, not including a canopy, of the front frame struts and arches, the back frame struts and arches, the connectors, the motor and worm gear housing, and the boat mounts.

FIG. 3 is an exploded view of an embodiment of the invention. FIG. 3 shows a port rear strut 302 and a port front strut 303 operatively connecting the actuator/worm gear assembly 315 to the Bimini canvas top (not shown). FIG. 3 shows starboard front interior strut 304 for adding interior support to the Bimini canvas top. FIG. 3 shows port front pivoting connector 305 and port back interior strut 306. Port drive mount 307 is shown for attaching to the boat (not shown). Port strut fasteners 308 and back arch center 309 are shown. Port-side back support leg 310 and back support leg fasteners 311 are shown, along with starboard side support leg 316, establishing a backward folding stop to support the Bimini system when it is retracted to its fully stowed position. Housing fastener nuts 312 and pivot fasteners 313 are shown with washer(s) 314. Actuator/worm gear assembly 315 is shown using self drilling screw 321 and mounting bumper 322 with port drive mount 307 for attaching to the boat. Arch fastener(s) 318 and arch fastener nut(s) 219 connect the struts to the arches.

Figure 4:
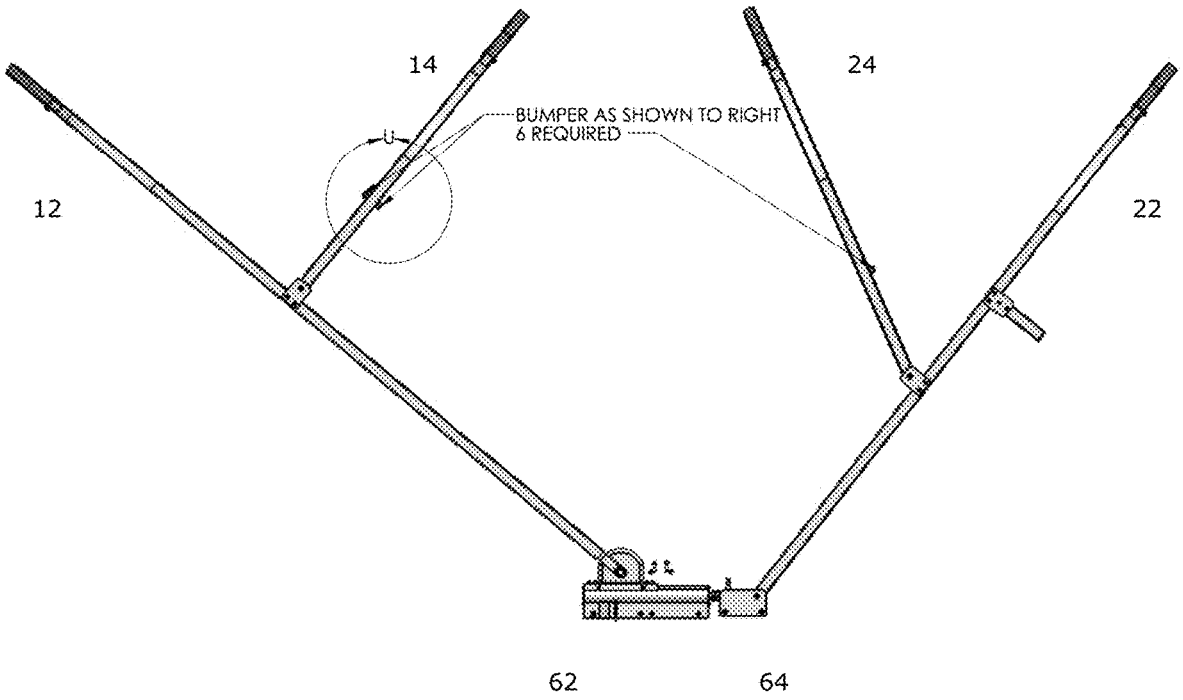
FIG. 4 is a plan view of one side, without a canopy, of the front frame struts and arches, the back frame struts and arches, the connectors, the motor and worm gear housing, and the boat mounts.

FIG. 4 is a plan view of an embodiment of the invention. FIG. 4 shows a single side of the bimini boat cover frame without a canopy. FIG. 4 shows front strut 12 pivotally attached to front interior strut 14, with the front strut 12 rotatably connected to the worm gear drive unit 62. FIG. 4 shows back strut 22 pivotally attached to back interior strut 24, and back strut 22 rotatably connected to the back boat mount 64.

Figure 5:
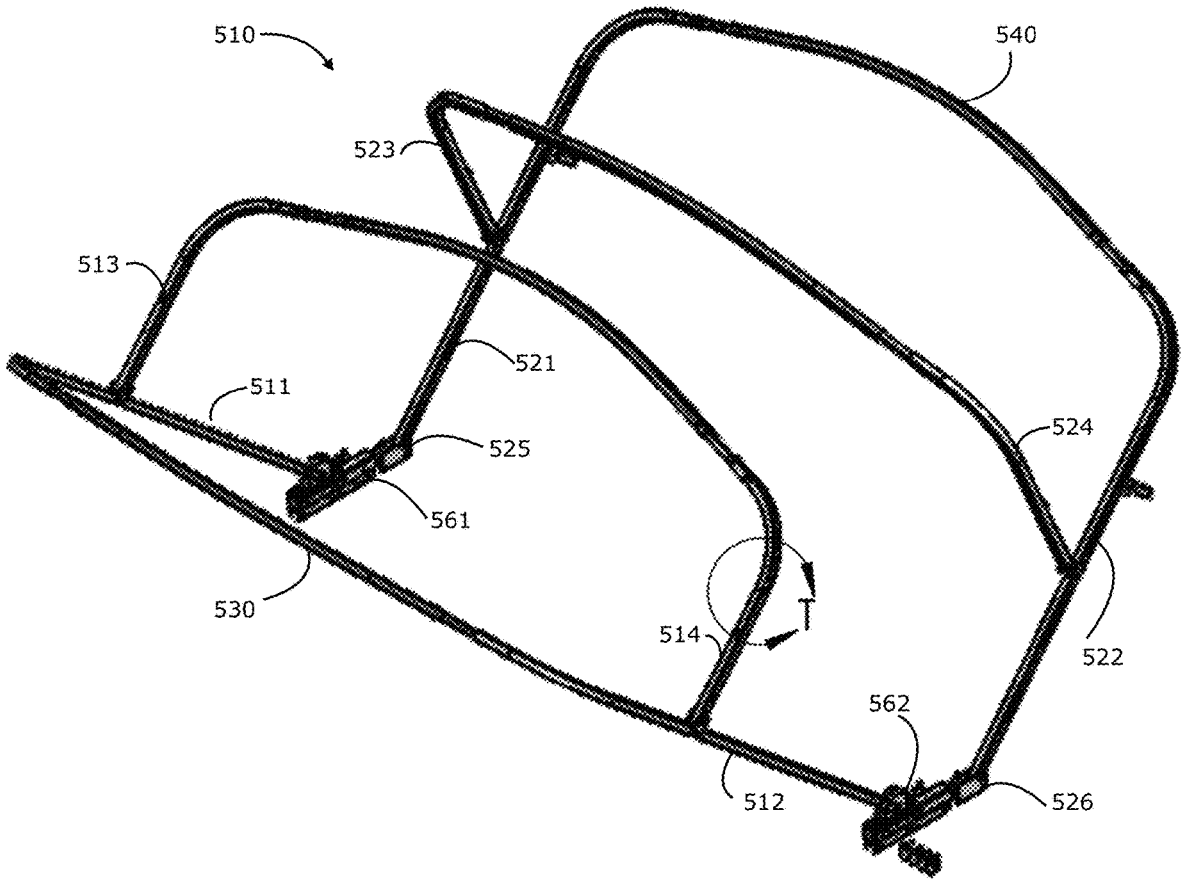
FIG. 5 is an overhead perspective view of an embodiment of the front frame struts and arches, the back frame struts and arches, the connectors, the motor and worm gear housing, and the boat mounts.

FIG. 5 is an overhead perspective view of an embodiment of the invention. FIG. 5 shows one embodiment of an entire boat cover frame 510 without the canopy. FIG. 5 shows the port-side front strut 512 pivotally attached to the port-side front interior strut 514, with the port-side front strut 512 rotatably connected to the port-side worm gear drive unit 562. FIG. 5 also shows the starboard-side front strut 511 connected by a spanning center arch frame segment 530, and starboard-side front strut 511 pivotally attached to the starboard-side front interior strut 513, with the starboard-side front strut 511 rotatably connected to the starboard-side worm gear drive unit 561. FIG. 5 shows the port-side back strut 522 pivotally attached to the port-side back interior strut 524, with the port-side back strut 522 rotatably connected to the port-side back boat mount 526. FIG. 5 also shows the starboard-side back strut 521 connected by a spanning center arch frame segment 540, and starboard-side back strut 521 pivotally attached to the starboard-side back interior strut 523, with the starboard-side back strut 521 rotatably connected to the starboard-side back boat mount 525.

Figure 6:
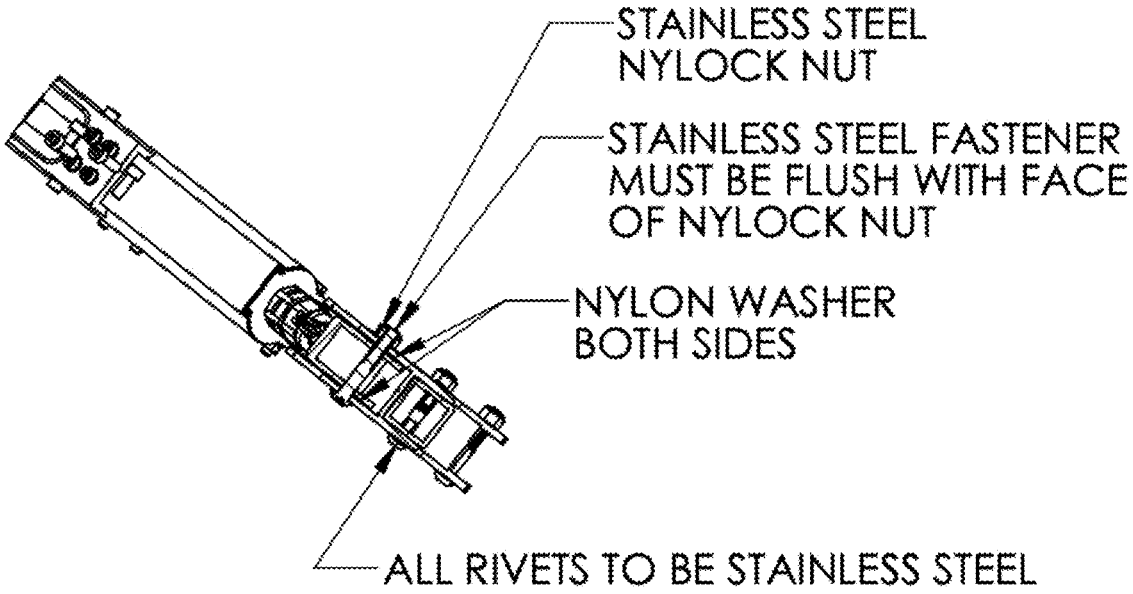
FIG. 6 is a top view of a pivotal connection for the invention.

FIG. 6 is a top view of a pivotal connection for the invention. FIG. 6 shows stainless steel nut and fastener with nylon washers for pivotally connecting frame members.

Figure 7:
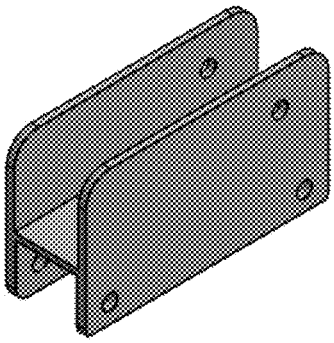
FIG. 7 is a perspective view of a bracket for the invention.

FIG. 7 is a perspective view of a mounting bracket for the invention. FIG. 7 shows how the lower thru-holes can be used to mount the bracket to the boat and how the upper thru-hole can be used to provide a rear pivoting connection.

Figure 8:
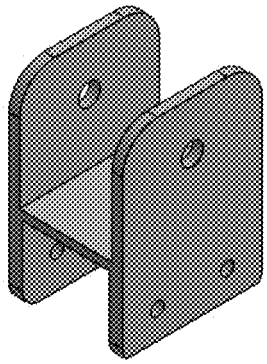
FIG. 8 is a perspective view of another bracket for the invention.

FIG. 8 is a perspective view of another mounting bracket for the invention. FIG. 8 shows how the lower thru-holes can be used to mount the bracket to a strut or frame member of the bimini and how the upper thru-hole can be used to provide a pivoting connection.

Figure 9:
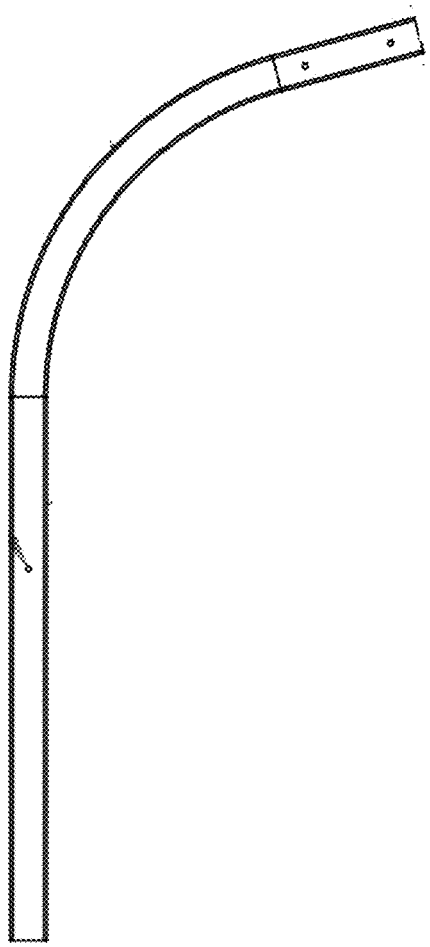
FIG. 9 is a plan view of a strut frame member of the invention.

FIG. 9 is a plan view of an arch frame member of the invention. FIG. 9 shows how the port- and starboard-front struts and back struts may be curved to mate with the center arch frame portions.

Figure 10:
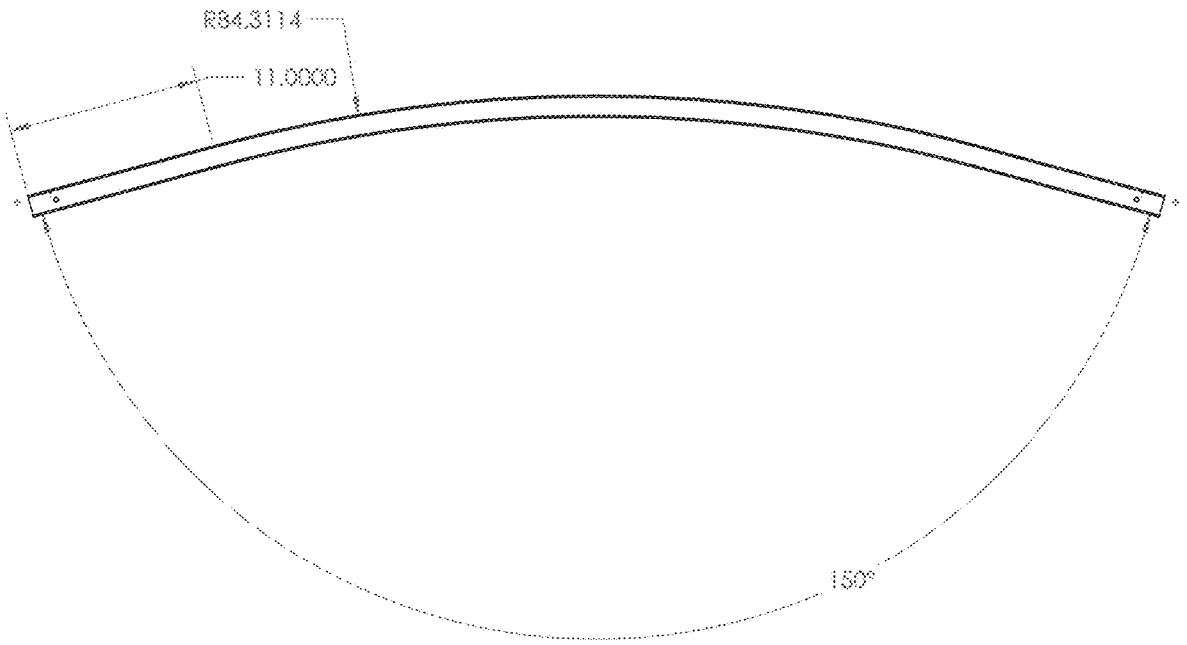
FIG. 10 is a plan view of an arch center frame member of the invention.

FIG. 10 is a plan view of an arch center frame member of the invention. FIG. 10 shows how the center arch frame member has a 150 degree curve to maximize strength and optimize the amount of canopy cover.

Figure 11:
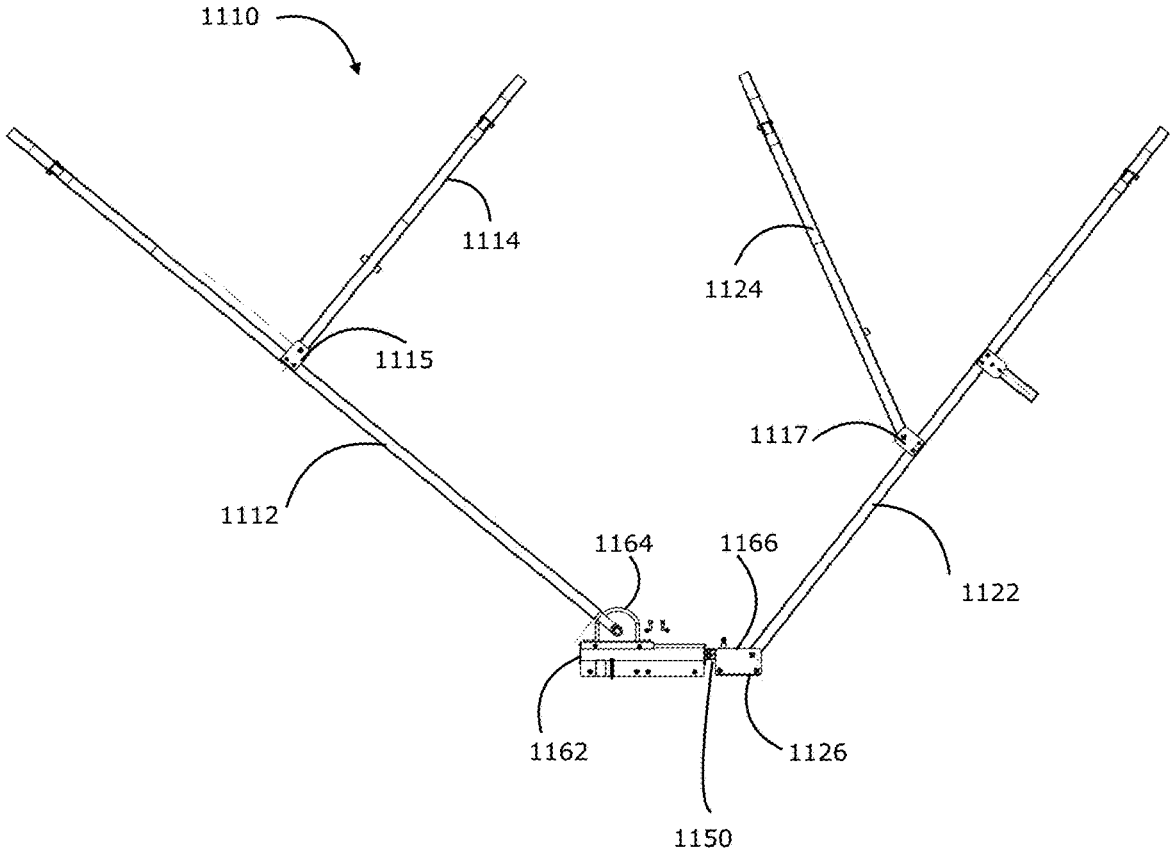
FIG. 11 is a plan view of another embodiment of one side, without a canopy, of the front frame struts and arches, the back frame struts and arches, the connectors, the motor and worm gear housing, and the boat mounts.

FIG. 11 is another plan view of the invention. FIG. 11 shows a single side of the bimini boat cover frame 1110 without a canopy. FIG. 11 shows the front strut 1112 pivotally attached to the front interior strut 1114, with the front strut 1112 rotatably connected to the worm gear drive unit 1162. FIG. 11 shows back strut 1122 pivotally attached to back interior strut 1124, and back strut 1122 rotatably connected to the back boat mount 1126. The pivoting brackets 1115, 1117 between the outer 1112, 1122 and interior struts 1114, 1124 are shown, along with the pivoting bracket 1126 that mounts the rear strut 1122 to the boat frame. Worm screw 1150 in worm gear drive unit 1162 drives first worm gear 1164 that actuates front strut 1112. Worm screw 1150 in worm gear drive unit 1162 is also shown extending to back boat mount 1126 where a second worm gear 1166 actuates rear strut 1122.

Figure 12:
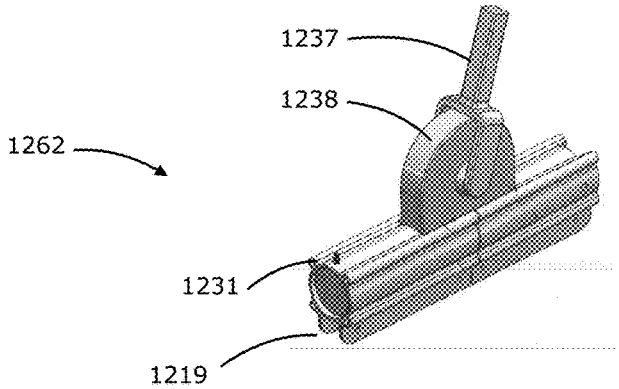
FIG. 12 is a perspective view illustration of one embodiment of the worm gear drive unit showing the boat mount, housing for the motor, planetary gear reducer, and worm gear, the gear cover, and the strut connector.

FIG. 12 is a perspective view illustration of one embodiment of the worm gear drive unit 1262 showing the boat mount 1219, housing for the motor 1231, frame strut connector 1237, and worm gear cover 1238. Not visible within the housing DC motor 1232, planetary gear reducer 1233, thrust bearings 1234, worm screw 1235, worm gear 1236, and. FIG. 12 shows how the worm gear drive unit 1262 is enclosed in a weather-proof, or waterproof, housing 1219.

Figure 13:
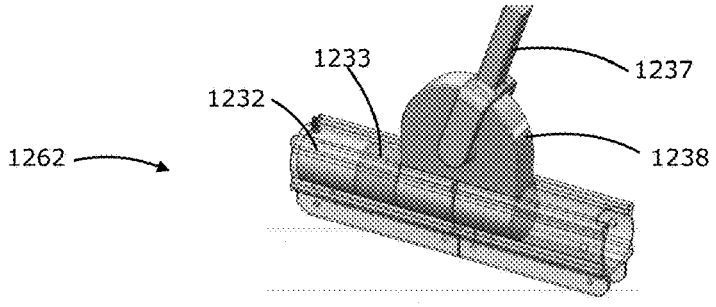
FIG. 13 is a perspective view illustration of one embodiment of the worm gear drive unit with a transparent illustration of the interior of the drive unit housing showing the motor, the planetary gear reducer, the gear cover/housing and the strut connector.

FIG. 13 is a perspective view illustration of one embodiment of the worm gear drive unit 1262 with a transparent illustration of the interior of the drive unit housing showing DC motor 1232, planetary gear reducer 1233, frame strut connector 1237 and worm gear cover 1238. Not visible within the housing are thrust bearings 1234, worm screw 1235, worm gear 1236. FIG. 13 shows how the DC motor is disposed within the housing, and engages directly with the planetary gear reducer, before engaging the worm drive—screw and gear.

Figure 14:
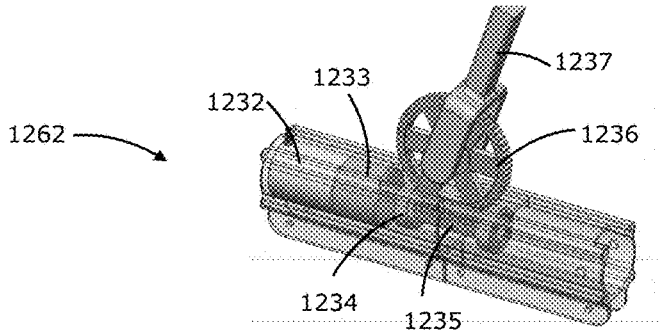
FIG. 14 is a perspective view illustration of one embodiment of the worm gear drive unit with a transparent illustration of the interior of the drive unit housing showing the motor, the planetary gear reducer, the worm screw, the thrust bearings, the worm gear, and the strut connector.

FIG. 14 is a perspective view illustration of one embodiment of the worm gear drive unit with a transparent illustration of the interior of the drive unit housing 1231 showing DC motor 1232, planetary gear reducer 1233, thrust bearings 1234, worm screw 1235, worm gear 1236, frame strut connector 1237 and worm gear cover 1238. FIG. 14 shows how the DC motor is disposed within the housing, and engages directly with the planetary gear reducer, before engaging the worm screw, which has thrust bearings at each end, which then engages the teeth of the worm gear.

Figure 15:
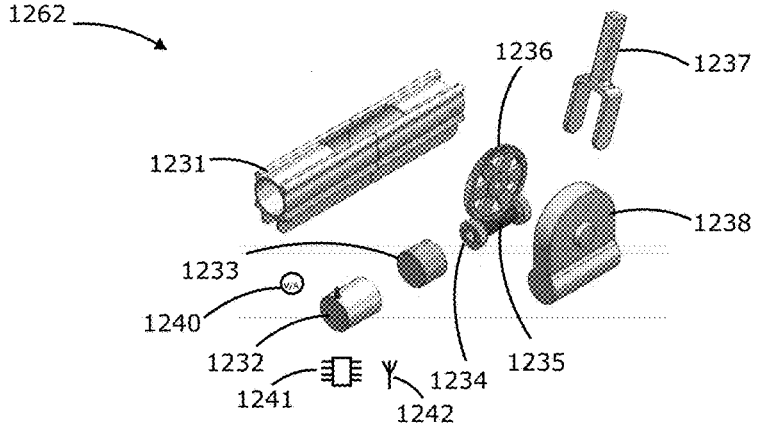
FIG. 15 is an exploded view illustration of one embodiment of the worm gear drive unit with a transparent illustration of the interior of the drive unit housing showing the motor, the planetary gear reducer, the worm screw, the thrust bearings, the worm gear, and the strut connector.

FIG. 15 is an exploded view illustration of one embodiment of the worm gear drive unit with a transparent illustration of the interior of the drive unit housing 1231 showing DC motor 1232, planetary gear reducer 1233, thrust bearings 1234, worm screw 1235, worm gear 1236, frame strut connector 1237 and worm gear cover 1238. FIG. 15 shows how the DC motor is disposed within the housing, and engages directly with the planetary gear reducer, before engaging the worm screw, which has thrust bearings at each end, which then engages the teeth of the worm gear. In a preferred embodiment, the planetary gear reducer provides an 84:1 ratio from the drive into the worm screw. In a preferred embodiment, the worm screw and gear have a ratio of 50:1. FIG. 15 also shows volt/amp sensor 1240 that is mounted on DC motor 1232 and which (sensor and motor) are connected to electronic controller (electronic control system) 1241 that includes a processor, non-volatile memory, and programming code executable on the processor configured to control motor voltage, control motor current, control battery voltage, control an autostop function, collect and save motor feedback, and control a Bluetooth module having a Bluetooth antenna 1242 for connecting by Bluetooth to a smartphone, receive commands from the smartphone to the controller, and send motor feedback to the smartphone (not shown).

Figure 16:
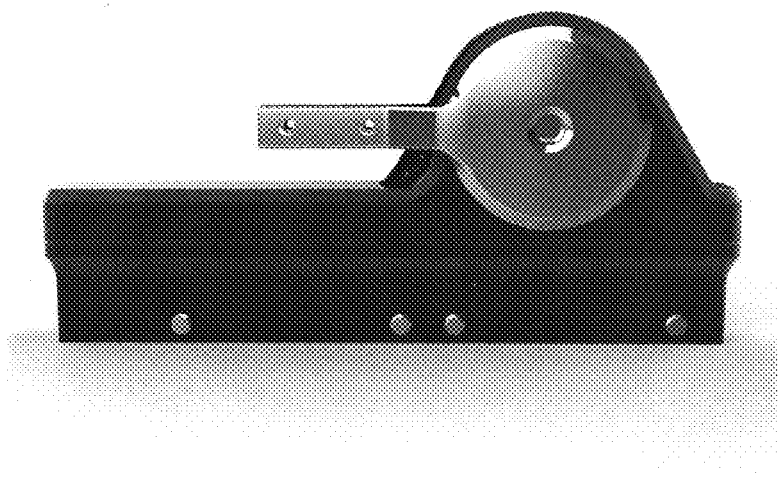
FIG. 16 illustration of one embodiment of the worm gear drive unit housing and the strut connector with chamfered and beveled edges around the strut connector cover, and the drive unit housing.

FIG. 16 is an illustration of one embodiment of the worm gear drive unit housing and the strut connector with chamfered and beveled edges around the strut connector cover, and the drive unit housing. This housing provides additional water-tight protection, and also provides a protective outer surface that will not snag clothing, swimsuit material, or other items that rubs against it, and also will prevent injury to users by avoiding scratching from the aluminum edges of other embodiments.

Figure 17:
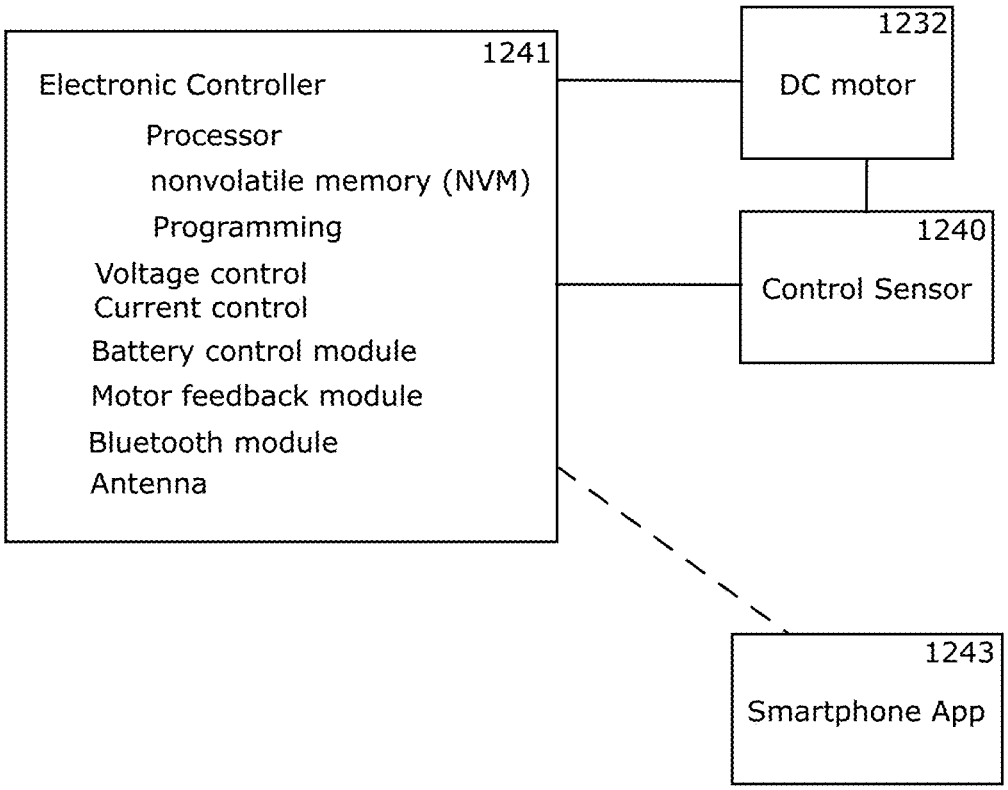
FIG. 17 is an electronic diagram illustrating the electronic controller in communication with the DC motor, the motor control sensor and a smartphone app on a user's smartphone.

FIG. 17 is an electronic diagram illustrating the electronic controller 1241 in communication with the DC motor 1232 and the motor control sensor 1240. FIG. 17 also shows the electronic controller in wireless communication with a smartphone app 1243 on a user's smartphone.

FIG. 18 is an electronic flowchart illustrating the processing Steps for using a bimini-style boat cover with a wireless electronic device. STEP 1: sending a command from the wireless electronic device using infrared signals or ultra-high frequency (UHF) (Bluetooth) signals to a bimini-style boat cover that is connected to power, wherein the command is selected from a menu of commands comprising raise the bimini, lower the bimini, control voltage to the motor, control current to the motor, control battery voltage, collect motor feedback, register new Bluetooth user, assign Bluetooth user password, display usage history, and display system faults. STEP 2: receiving the command at the electronic controller of the bimini-style boat cover and executing the command on the processor using programming code saved to memory, wherein a command to raise the bimini and lower the bimini actuates the DC motor to drive the worm gear connected to frame assembly, wherein a command to control voltage to the DC motor modifies the speed of the DC motor and control current to the DC motor modifies the torque of the DC motor, wherein a command to control battery voltage modifies the voltage incoming from a battery power supply, and wherein a command to collect DC motor feedback, register new Bluetooth user, assign Bluetooth user password, display usage history, and display system faults operates to process data received from the electronic controller and generate a graphic on a display screen on the wireless electronic device.

Many modifications and variations can be made without departing from its spirit and scope, as will be apparent to those skilled in the art. These embodiments should be understood that they have been presented by way of example only, and not limitation. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled.

This disclosure is not limited, unless so stated, to particular methods, order of processing steps, components, materials, systems, partial aspects of processes, components or systems, uses, compounds, compositions, standards, routines, modes, computers, hardware, firmware, and software programming which can, of course, vary. Where methods described above indicate events occurring in specific order, the ordering of events is sequential, but the invention contemplated herein may also include modifications that do not depart from the scope and spirit of the invention. Additionally, certain of the events may be performed concurrently in a parallel process when possible, as well as performed sequentially as described above. Where schematics and/or embodiments described above indicate certain components arranged in certain orientations or positions, the arrangement of components is specified, but the invention contemplated herein may also include modifications that do not depart from the scope and spirit of the invention.

Any portion of the apparatus and/or methods described herein may be combined in any combination, except mutually exclusive combinations, and can include various combinations and/or sub-combinations of the functions, components, and/or features of the different embodiments described that do not depart from the scope and spirit of the invention.

Various presently unforeseen or unanticipated alternatives, modifications, variations, or improvements therein may be subsequently made by those skilled in the art, each of which is also intended to be encompassed by the disclosed embodiments. It is therefore to be understood that within the novel, unobvious, enabled, and described scope of the broadest reasonable interpretation of the appended claims, the invention may be practiced otherwise than as narrowly described. Accordingly, all such modifications are intended to be included within the novel, unobvious, enabled, and described scope of this invention as defined in the broadest reasonable interpretation of the following claims.

What is claimed as the invention:

1. A bimini-style boat cover, comprising a front frame assembly and a back frame assembly that support a canopy covering, the front frame assembly operatively connected to a first electronically actuated worm gear drive unit, the worm gear drive unit mounted on a boat, the worm gear drive unit having a housing containing a worm gear motor assembly comprising a controller connected to a DC motor that engages directly with a planetary gear reducer before engaging a worm screw, said worm screw having thrust bearings at each end, and said worm screw engaging teeth of a worm gear, said worm gear connected to the front frame assembly, the worm gear drive unit configured to raise the front frame assembly from a stowed first position to a raised second position, the back frame assembly pivotally mounted on the boat and configured to rotate in response to the canopy covering attached to the front frame assembly when the front frame assembly moves from the stowed first position to the raised second position, said controller comprising a processor, non-volatile memory, a control sensor attached to the DC motor, and programming code executable on the processor configured to control motor voltage and control motor current.

2. The bimini-style boat cover of claim 1, wherein the programming code executable on the processor is configured to control battery voltage, control an autostop function, and collect and save motor feedback.

3. The bimini-style boat cover of claim 1, wherein the controller includes a Bluetooth module having a Bluetooth antenna and programming code executable on the processor configured to connect by Bluetooth to a smartphone, receive commands from the smartphone to the controller, and send motor feedback to the smartphone.

4. The bimini-style boat cover of claim 1, comprising a second electronically actuated worm gear drive unit, the front frame assembly having a port side strut and a starboard side strut connected by a center arch member, the first electronically actuated worm gear drive unit operatively connected to the port side strut, and the second electronically actuated worm gear drive unit operatively connected to the starboard side strut, the first electronically actuated worm gear drive unit and the second electronically actuated worm gear drive unit in electronic communication to effect synchronized movement to the port side strut and the starboard side strut when the front frame assembly moves between the stowed first position and the raised second position.

5. The bimini-style boat cover of claim 1, comprising a second electronically actuated worm gear drive unit operatively connected to the back frame assembly, the first electronically actuated worm gear drive unit and the second electronically actuated worm gear drive unit in electronic communication to effect synchronized movement to the front frame assembly and the back frame assembly when the front frame assembly moves between the stowed first position and the raised second position.

6. The bimini-style boat cover of claim 1, wherein the planetary gear reducer provides an 84:1 ratio from the DC motor into the worm screw.

7. The bimini-style boat cover of claim 1, wherein the worm screw and worm gear have a ratio of 50:1.

8. The bimini-style boat cover of claim 1, wherein the front frame assembly is configured as an inverted u-shaped arch comprising a port-side front strut connected to a starboard-side front strut using a curved front center arch, the front frame assembly also having a short interior arch comprising a port-side short front strut connected to a starboard-side short front strut using a curved front interior center arch, the port-side short front strut connected to a mid-section portion of the port-side front strut and the starboard-side short front strut connected to a mid-section portion of the starboard-side front strut, and wherein the back frame assembly is configured as an inverted u-shaped arch comprising a port-side back strut connected to a starboard-side back strut using a curved back center arch, the back frame assembly also having a short interior arch comprising a port-side short back strut connected to a starboard-side short back strut using a curved back interior center arch, the port-side short back strut connected to a mid-section portion of the port-side back strut and the starboard-side short back strut connected to a mid-section portion of the starboard-side back strut, and wherein the front frame and the back frame are attached to a canopy wherein the canopy covers the curved front center arch, the curved front interior center arch, covers the curved back center arch, and covers the curved back interior center arch, and wherein the canopy covers a top curved portion of the port-side front strut, a top curved portion of the starboard-side front strut, a top curved portion of the port-side short front strut, and a top curved portion of the starboard-side short front strut, and wherein the canopy covers a top curved portion of the port-side back strut, a top curved portion of the starboard-side back strut, a top curved portion of the port-side short back strut, and a top curved portion of the starboard-side short back strut.

9. The bimini-style boat cover of claim 1, wherein the DC motor is a variable speed motor, and wherein the controller is configured for automatic pre-programmed stops, and configured for slowing speed to provide soft-stops.

10. The bimini-style boat cover of claim 1, wherein the worm gear drive unit controller is wired or wireless.

11. The bimini-style boat cover of claim 1, wherein the worm gear housing is enclosed and weather proof.

12. The bimini-style boat cover of claim 1, wherein the worm gear is enclosed and a submersion test allows in less than 20 ml of water into the housing, wherein the worm gear has resistance to stripping force having a range to resist stripping force from 400 ft lbs to 1100 ft lbs., wherein the worm gear maintains function under force and does not lock up at 400 ft lbs to 1100 ft lbs of force, and wherein the worm gear ranges from 5000 to 100,000 travels between replacements.

13. A method of using a bimini-style boat cover with a wireless electronic device, comprising:

(i) sending a command from the wireless electronic device using infrared or ultra-high frequency (UHF) signals to a bimini-style boat cover of claim 1 that is connected to power, wherein the command is selected from a menu of commands comprising raise the bimini, lower the bimini, control voltage to the motor, control current to the motor, control battery voltage, collect motor feedback, register new Bluetooth user, assign Bluetooth user password, display usage history, and display system faults;

(ii) receiving the command at the electronic controller of the bimini-style boat cover of claim 1 and executing the command on the processor using programming code saved to memory, wherein a command to raise the bimini and lower the bimini actuates the DC motor to drive the worm gear connected to frame assembly, wherein a command to control voltage to the DC motor modifies the speed of the DC motor and control current to the DC motor modifies the torque of the DC motor, wherein a command to control battery voltage modifies the voltage incoming from a battery power supply, and wherein a command to collect DC motor feedback, register new Bluetooth user, assign Bluetooth user password, display usage history, and display system faults operates to process data received from the electronic controller and generate a graphic on a display screen on the wireless electronic device.

14. A bimini-style boat cover, comprising a front frame assembly and a back frame assembly that support a canopy covering, the front frame assembly operatively connected to a first electronically actuated worm gear drive unit, the worm gear drive unit mounted on a boat, the worm gear drive unit having a housing containing a worm gear motor assembly comprising a controller connected to a DC motor that engages directly with a planetary gear reducer before engaging a worm screw, said worm screw having thrust bearings at each end, and said worm screw engaging teeth of a worm gear, said worm gear connected to the front frame assembly, the worm gear drive unit configured to raise the front frame assembly from a stowed first position to a raised second position, the back frame assembly pivotally mounted on the boat and configured to rotate in response to the canopy covering attached to the front frame assembly when the front frame assembly moves from the stowed first position to the raised second position, said controller comprising a processor, non-volatile memory, a control sensor attached to the DC motor, and programming code executable on the processor configured to control motor voltage and control motor current, wherein the front frame assembly is configured as an inverted u-shaped arch comprising a port-side front strut connected to a starboard-side front strut using a curved front center arch, the front frame assembly also having a short interior arch comprising a port-side short front strut connected to a starboard-side short front strut using a curved front interior center arch, the port-side short front strut connected to a mid-section portion of the port-side front strut and the starboard-side short front strut connected to a mid-section portion of the starboard-side front strut, and wherein the back frame assembly is configured as an inverted u-shaped arch comprising a port-side back strut connected to a starboard-side back strut using a curved back center arch, the back frame assembly also having a short interior arch comprising a port-side short back strut connected to a starboard-side short back strut using a curved back interior center arch, the port-side short back strut connected to a mid-section portion of the port-side back strut and the starboard-side short back strut connected to a mid-section portion of the starboard-side back strut, and wherein the front frame and the back frame are attached to a canopy wherein the canopy covers the curved front center arch, the curved front interior center arch, covers the curved back center arch, and covers the curved back interior center arch, and wherein the canopy covers a top curved portion of the port-side front strut, a top curved portion of the starboard-side front strut, a top curved portion of the port-side short front strut, and a top curved portion of the starboard-side short front strut, and wherein the canopy covers a top curved portion of the port-side back strut, a top curved portion of the starboard-side back strut, a top curved portion of the Dort-side short back strut, and a top curved portion of the starboard-side short back strut, wherein a port-side rear strut mount is slidably adjustable to travel closer and further to a port-side worm gear drive unit, and a starboard-side rear strut mount is slidably adjustable to travel closer and further to a starboard-side worm gear drive unit.

15. The bimini-style boat cover of claim 14, wherein the first electronically actuated worm gear drive unit is operatively connected to the port-side front strut, and comprising a second electronically actuated worm gear drive unit operatively connected to the starboard-side front strut, the first electronically actuated worm gear drive unit and the second electronically actuated worm gear drive unit in electronic communication to effect synchronized movement to the front frame assembly and the back frame assembly when the front frame assembly moves between the stowed first position and the raised second position, wherein the first and second electronically actuated worm gear drive units include a planetary reducer, and a worm gear ratio to eliminate backdrive, preventing slippage.

16. The bimini-style boat cover of claim 14, wherein a port-side worm gear is connected to and synchronously drives both the port-side front strut and the port-side back strut, and a starboard-side worm gear is connected to and synchronously drives both the starboard-side front strut and the starboard-side back strut.

17. The bimini-style boat cover of claim 14, wherein the port-side and the starboard-side worm gear drive units are configured for electronically synchronized independent drives, wherein the port-side worm gear is connected to and synchronously drives both the port-side front strut and the port-side back strut, and the starboard-side worm gear is connected to and synchronously drives both the starboard-side front strut and the starboard-side back strut.

18. The bimini-style boat cover of claim 14, wherein the port-side worm gear and the starboard-side worm gear are mounted on the boat at a position that directly below an outer edge of a canopy space between a curved front interior center arch and a curved back interior center arch to balance strut forces from wind or rain that translate from canopy movement to gear pressure through the front frame assembly and the back frame assembly.

* * * * *